US006230671B1

(12) United States Patent
Achterberg

(10) Patent No.: US 6,230,671 B1
(45) Date of Patent: May 15, 2001

(54) VARIABLE COMPRESSION AND ASYMMETRICAL STROKE INTERNAL COMBUSTION ENGINE

(76) Inventor: Raymond C. Achterberg, 2124 Belvo Rd., Miamisburg, OH (US) 45342-3904

( * ) Notice: Subject to any disclaimer, the term of this patent is extended or adjusted under 35 U.S.C. 154(b) by 0 days.

(21) Appl. No.: 09/184,177

(22) Filed: Nov. 2, 1998

(51) Int. Cl.[7] ..... F02B 75/18
(52) U.S. Cl. ..... 123/48 R; 123/52.4; 123/53.3
(58) Field of Search ..... 123/48 A, 48 AA, 123/48 D, 78 A, 78 D, 48 R, 52.4, 53.3

(56) References Cited

U.S. PATENT DOCUMENTS

| | | | | |
|---|---|---|---|---|
| 1,135,942 | * | 4/1915 | Logain | 123/51 A |
| 1,243,522 | * | 10/1917 | Hillhouse | 123/78 A |
| 1,521,077 | * | 12/1924 | Clegg | 123/78 A |
| 1,574,574 | | 2/1926 | Hale . | |
| 1,914,707 | | 6/1933 | Wolf . | |
| 1,940,533 | | 12/1933 | Cain . | |
| 2,118,153 | | 5/1938 | Buchwalder . | |
| 3,312,206 | | 4/1967 | Radovic . | |
| 3,741,175 | | 6/1973 | Rouger . | |
| 3,868,931 | * | 3/1975 | Dutry et al. | 123/51 R |
| 3,961,607 | * | 6/1976 | Brems | 123/78 D |
| 4,143,628 | | 3/1979 | Gustavsson . | |
| 4,169,435 | | 10/1979 | Faulconer . | |
| 4,190,024 | | 2/1980 | Davis . | |
| 4,419,969 | | 12/1983 | Bundrick, Jr. . | |
| 5,058,536 | * | 10/1991 | Johnston | 123/51 BA |
| 5,188,066 | * | 2/1993 | Gustavsson | 123/48 A |

* cited by examiner

*Primary Examiner*—Marguerite McMahon
*Assistant Examiner*—Jason Benton
(74) *Attorney, Agent, or Firm*—R. William Graham

(57) ABSTRACT

A variable compression and asymmetrical stroke internal combustion engine includes a cylinder, a drive piston reciprocally disposed in the cylinder, an auxiliary piston reciprocally disposed in the cylinder, apparatus for reciprocating the auxiliary piston at twice the speed of the drive piston and in a manner wherein the relative reciprocation is asymmetrical, an intake port communicably connected to the cylinder, an exhaust port communicably connected to the cylinder, and an ignition device operably connected to the cylinder.

7 Claims, 9 Drawing Sheets t2 t3 t4

VARIABLE COMPRESSION AND ASYMMETRICAL STROKE INTERNAL COMBUSTION ENGINE

BACKGROUND OF INVENTION

1. Field of the Invention

This invention relates to internal combustion engines, and more particularly to an improvement in engines of the type employing main and auxiliary pistons.

2. Prior Art

The internal combustion engine of the present invention differs in significant regard from prior conventional internal combustion engines of the two stroke cycle and four stroke cycle types. However, certain terminology developed with reference to such previously known engines is of value in clarifying the operation of the engine of this invention.

The quasi harmonic motion of a piston operatively connected to a crankshaft has given rise to such terminology as "top dead center" (TDC) and "bottom dead center" (BDC) positions of a piston. Top dead center position refers to a position of the piston, connecting rod and crankshaft in which the axis of rotation of the crankshaft and the axis of pivotal connection of the connecting rod with the piston and the crankshaft are aligned while the piston is at its furthest distance from the center of the rotation of the crankshaft. Bottom dead center is the position in which the axis of rotation and pivotal movement are aligned while the piston is in its position of most close approach to the center of rotation of the crankshaft. Another term used in a conjunction with conventional internal combustion engines is "displacement" meaning the volume swept by a piston in one stroke. Prior engines are described hereinafter.

Bundrick, Jr., U.S. Pat. No. 4,419,969, is directed to an internal combustion engine with manual adjustable cylinder compression. Opposing pistons are shown with one crank having a third larger crank than the other.

Davis, U.S. Pat. No. 4,190,024, discloses a variable chamber diesel engine. The engine is two cycle with a glow plug to ignite fuel and has means for varying the combustion chamber.

Faulconer, Jr., U.S. Pat. No. 4,169,435, discloses an internal combustion engine. The engine includes opposing pistons and operate in a manner to maintain increased pressure on the power piston through the combustion stroke. There is an upper piston which moves through a complex motion to create a super charged engine. Faulconer, Jr. also mentions a constant volume during the combustion phase.

Radovic, U.S. Pat. No. 3,312,206, discloses a reciprocating engine for increasing power. The engine includes a cam actuated above a conventional work piston. Radovic mentions a constant volume during the combustion phase.

Rouger, U. S. Pat. No. 3,741,175, discloses a variable compression ratio internal combustion engine for increased power. There is shown an auxiliary piston operating at one half the main piston frequency and a linkage for varying the compression ratio for both two-cycle and four-cycle engines.

Dutry, U.S. Pat. No. 3,868,931, discloses an auxiliary piston rotating at more than twice that of the crankshaft cooperating with the piston of the working cylinder and is preferably three times as great. It would appear the pistons must operate at integer ratios so the cycles can repeat. The claim here seems to be that holding the charge at a constant volume during ignition promotes more complete combustion and less pollutants.

Gustavasson, U.S. Pat. No. 4,143,628, discloses a variable compression ratio engine. The linkage seems to be the focal point of the patent. There appears to be no provisions for valving.

Hale, U.S. Pat. No. 1,574,574, discloses an internal combustion engine, wherein the firing of the charge occurs after TDC to prevent "back kick." This was a problem while hand cranking, prior to the electric starter and the automatic spark timing control. Many an arm, wrist, and hand were broken because someone forgot to "retard the spark" to insure firing after TDC. The auxiliary piston appears to be relatively stationary during the power stroke.

Wolf, U.S. Pat. No. 1,914,707, discloses an internal combustion engine which fires the charge after TDC as a method of increasing the torque on the crankshaft. Two opposing pistons are shown wherein an upper (non power) piston is moved as a function of a cam and cam follower.

Cain, U.S. Pat. No. 1,940,533, discloses a four-cycle internal combustion engine. There is an indication of complete expulsion of the exhaust gases.

Buchwalder, U.S. Pat. No. 2,118,153, discloses an internal combustion engine with an auxiliary piston to optimize on the conventional engine. Through an elaborate and costly mechanism, one power stroke per main crank revolution is obtained. A longer power stroke to intake stroke is also disclosed. A more complete expulsion of the exhaust gases is disclosed as well as the use of ports to carry out the exhaust phase of the mechanism.

While there have been many improvements in the internal engine, there remains a need for more efficient engine. Particularly, improvements of volumetric, lubrication and combustion efficiency are needed. It is also desirable to obtain such efficiencies with manufacturing economy.

SUMMARY OF THE INVENTION

It is an object to improve the internal combustion engine.

It is another object to increase the aforesaid efficiencies of an internal combustion engine.

It is yet another object to enhance the wearability of internal combustion engine.

It is another object to decrease pollution of the internal combustion engines.

Accordingly, the present invention is directed to a variable compression and asymmetrical stroke internal combustion engine which is intended to accomplish the aforesaid objectives. The improvements of such engine include:

a cylinder, a drive piston reciprocally disposed in the cylinder, an auxiliary piston reciprocally disposed in the cylinder, means for reciprocating the auxiliary piston at twice the speed of the drive piston and in a manner wherein the relative reciprocation is asymmetrical, an intake port communicably connected to the cylinder, an exhaust port communicably connected to the cylinder, and an ignition device operably connected to the cylinder.

Further, the reciprocating means includes a drive crank movably connected to the drive piston, a drive gear movably connected to the drive crank, an auxiliary crank movably connected to the auxiliary piston, an auxiliary gear moveably connected to the auxiliary crank, wherein the auxiliary gear is one half the diameter of the drive gear, and a timing chain (or a plurality of gears) operably interconnects the drive gear and auxiliary gear. The drive gear is connected to a drive shaft. Also, provided is an automatic controller which controls the intake and exhaust ports and ignition device.

Other objects and advantages will be readily apparent to those skilled in the art upon viewing the drawings and reading the detailed description hereafter.

DETAILED DESCRIPTION OF PREFERRED EMBODIMENT

Figure 1:
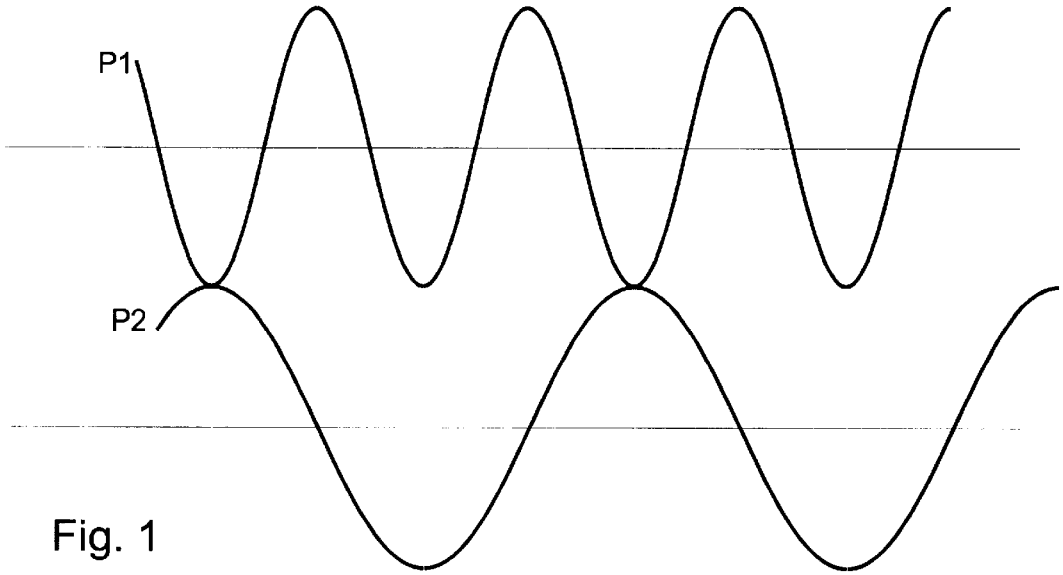
FIG. 1 shows a diagram representing cycles of pistons operating in phase.
Figure 2:
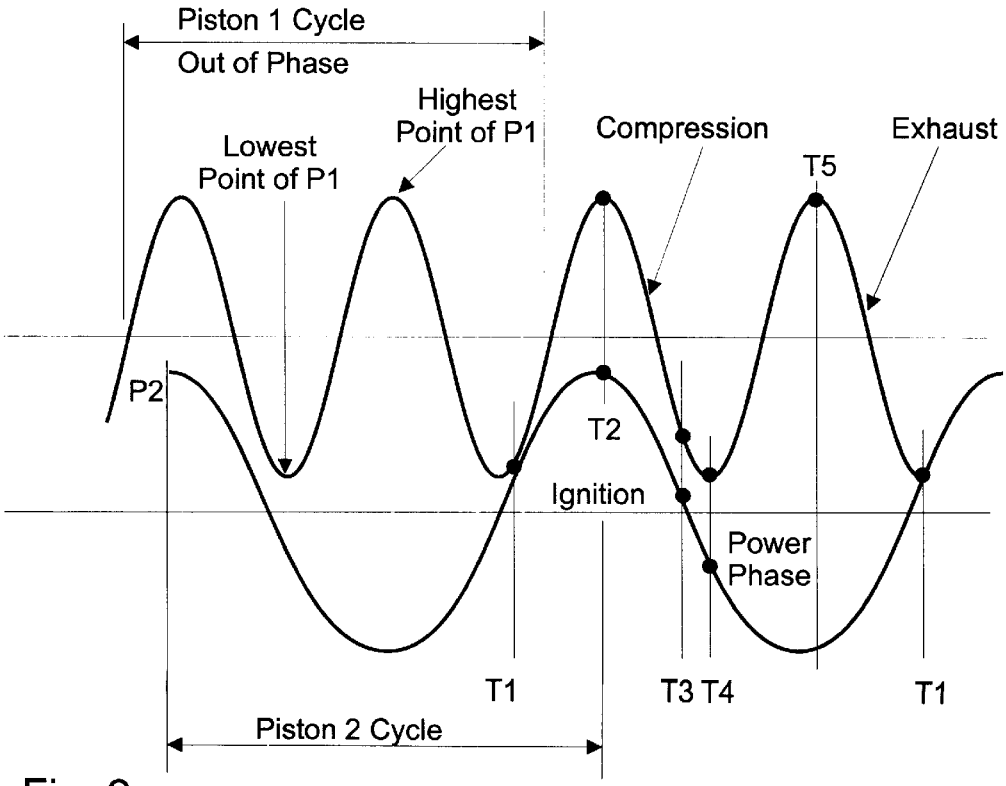
FIG. 2 shows a diagram representing cycles of pistons of the present invention operating at about one quarter out of phase.
Figure 3:
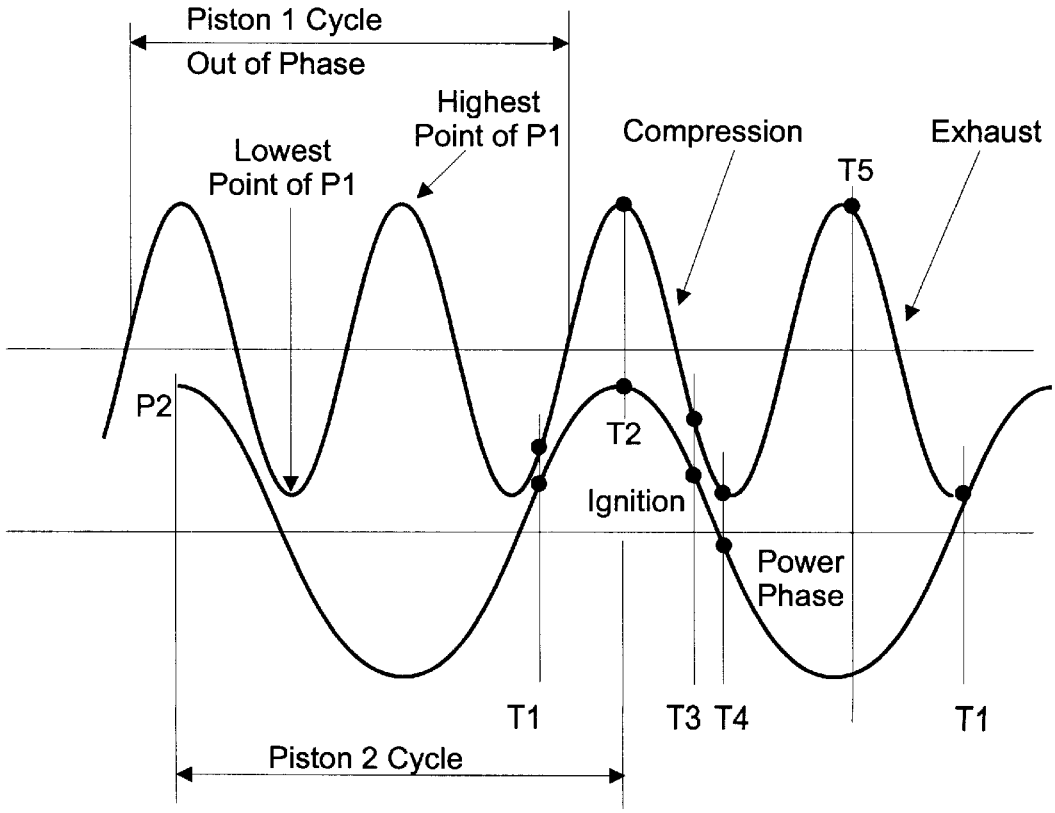
FIG. 3 shows a diagram representing cycles of pistons of the present invention operating at about one quarter out of phase yet having a slightly higher compression at combustion.

Referring now to the drawings, the present invention is represented by the numeral 10. The invention may also be referred to herein after as "improvements" 10 of the internal combustion engine having variable compression and asymmetrical stroke.

The following description in conjunction with viewing the drawings will aid in understanding the present invention. The structure and operation are as follows.

The improvements 10 include a cylinder 12, drive piston 14, auxiliary piston 16, drive crank 22, drive gear 24, auxiliary crank 26, auxiliary gear 32, timing chain 34, intake port 38, ignition device 40, and exhaust port 42. An automated controller 44 is also provided.

It is contemplated that as opposed to the timing chain 34 described herein, a plurality of interconnecting helical gears 31 can be employed to carry out the intended purposes of the timing chain 34. The gears 31 can be manually or automatically adjusted to affect phase shift of the pistons 14 an 16.

The pistons 14 and 16 are reciprocally disposed within the cylinder 12 in a manner to be reciprocated back and forth toward and away from one another. In the present invention, these pistons 14 and 16 are out of symmetrical stroke with respect to one another, preferably by one quarter phase, to achieve the efficiency as depicted in FIG. 1. However, it is contemplated that shifting the phase can enhance certain desired efficiencies of the engine.

The drive gear 24 is two times the diameter of the auxiliary gear 32. The drive gear 24 is interconnected to the drive piston 14 via the drive crank 22, wherein arms 20 and 18 of the drive crank 18 operably connect to the drive piston 14 and a central splined portion of the drive gear 24, respectively. The auxiliary gear 32 is interconnected to the auxiliary piston 16 via the auxiliary crank 26, wherein arms 27 and 28 operably connect to the auxiliary piston 16 and a central splined portion of the auxiliary gear 32, respectively. The drive cranks arms 20 and 18 and auxiliary cranks arms 27 and 28 are rotatably connected to one another. At ignition $t_1$, the pistons 14 and 16 are slightly past TDC to provide positive movement.

The gears 24 and 32 are rotated to positions such that the strokes of pistons 14 and 16 are asymmetrical and the desired phase is selected, then the timing chain 34 is operably positioned on the gears 32 and 24. FIG. 1 depicts the phase shift being one quarter. Variations of the phase shift can be used to further optimize efficiencies, such as thermal, volumetric, lubrication and combustion. In this regard, there is provided a gear 25 which operably connects to the timing chain 34. The gear 25 is movably connected to an arm 29 which in turn is operably connected to a controller 31 which indirectly controls the displacement of the timing chain 34 and phase shift accordingly.

The intake port 38 is communicably connected to the cylinder 12 adjacent the auxiliary piston 16. The ignition device 40 is operably disposed within the cylinder 12 between the pistons 14 and 16. The exhaust port 42 is communicably connected to the cylinder 12 adjacent the drive piston 14.

The operation of the invention is as follows and is followed by viewing FIGS. 2–9 with the respect to FIG. 1 at the times shown therein. A complete cycle occurs from intake through exhaust ($t_1$ and $t_5$). The lower curve P2 represents the harmonic motion of the drive piston 14. The upper curve P1 represents the harmonic motions of auxiliary piston 16. The spacing between the curves P1 and P2 represents the volumetric displacement between the auxiliary piston and drive piston. The peaks and valleys of the curves represent the TDC and the BDC points, respectively, for the pistons 14 and 16.

The space between pistons 14 and 16 is filled with fuel-air mixture during the period between $t_1$ and $t_2$. The period between $t_2$ and $t_3$ shows the compression of the volume of space and fuel-air mixture.

From the point $t_3$ to $t_4$ at approximately constant volume, ignition takes place. The pressure caused by the explosive forces of fuel-air mixture being ignited causes the pistons 14 and 16 to be driven away from one another. The space between the period $t_3$ and $t_4$ represents the approximat constant volume.

The power phase of the engine is represented between $t_4$ and $t_5$, wherein the piston 14 and 16 are driven furthest apart. The space between $t_5$ and $t_1$ represents an exhaust phase wherein the waste gas is removed through the exhaust port 42.

The position of the intake port 38 and exhaust port 42 are shown by way of example. These ports 38 and 42 are preferably controlled by the automatic controller 44 which is connected to valve 46 and can be opened at $t_1$ for intake and closed at $t_2$ for compression. Likewise, the automatic controller 44 is connected to valve 48 and can be opened at $t_5$ for exhausting waste and closed again at $t_1$.

By so providing, the present invention has improved efficiencies in the internal combustion engine. Gases can expand further than in a conventional engine so that more energy will be extracted and thermal efficiency gained. The combusted gases move along the cylinder 12 and less hot spots are therefore likely formed. Combustion which occurs in the present invention is less likely to cause carbon build-up and engine knocking. The engine of the present invention will run cooler by virtue of greater expansion and exhausting capabilities. By using the present invention, there is less need for oil changes because lower temperatures can be obtained by removing the exhaust more efficiently thereby retarding oil breakdown. Finally, horse power can be increased by use of the present invention.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A variable compression and asymmetrical stroke internal combustion engine, which includes:

a cylinder;

a drive piston reciprocally disposed in said cylinder, an auxiliary piston reciprocally disposed in said cylinder;

means for reciprocating said auxiliary piston at twice the speed of said drive piston and in a manner wherein the relative reciprocation is asymmetrical wherein an exhaust phase is substantially completed when said drive piston and said auxiliary piston are at a nearest point to one another;

an intake port communicably connected to said cylinder;

an exhaust port communicably connected to said cylinder; and an ignition device operably connected to said cylinder.

2. The variable compression and asymmetrical stroke internal combustion engine of claim 1, wherein said reciprocating means includes a drive crank movably connected to said drive piston, a drive gear movably connected to said drive crank, an auxiliary crank movably connected to said auxiliary piston, an auxiliary gear moveably connected to said auxiliary crank, and timing means interconnecting said drive gear and said auxiliary gear for rotating said drive gear and said auxiliary gear.

3. The variable compression and asymmetrical stroke internal combustion engine of claim 2, wherein said auxiliary gear is one half said diameter of said drive gear and said timing means includes a timing chain operably disposed about and interconnecting peripheral teeth of said drive gear and peripheral teeth of auxiliary gear.

4. The variable compression and asymmetrical stroke internal combustion engine of claim 1, which further includes a drive shaft connected to said drive gear.

5. The variable compression and asymmetrical stroke internal combustion engine of claim 4, which further includes an auxiliary drive shaft connected to said auxiliary gear.

6. The variable compression and asymmetrical stroke internal combustion engine of claim 1, which further includes means for controlling said intake port, said exhaust port and said ignition device.

7. The variable compression and asymmetrical stroke internal combustion engine of claim 1, which further includes another means connected to said reciprocating means for one of manually and automatically adjusting phase shift between said drive piston and said auxiliary piston.

* * * * *

UNITED STATES PATENT AND TRADEMARK OFFICE

CERTIFICATE OF CORRECTION

Figure 4:
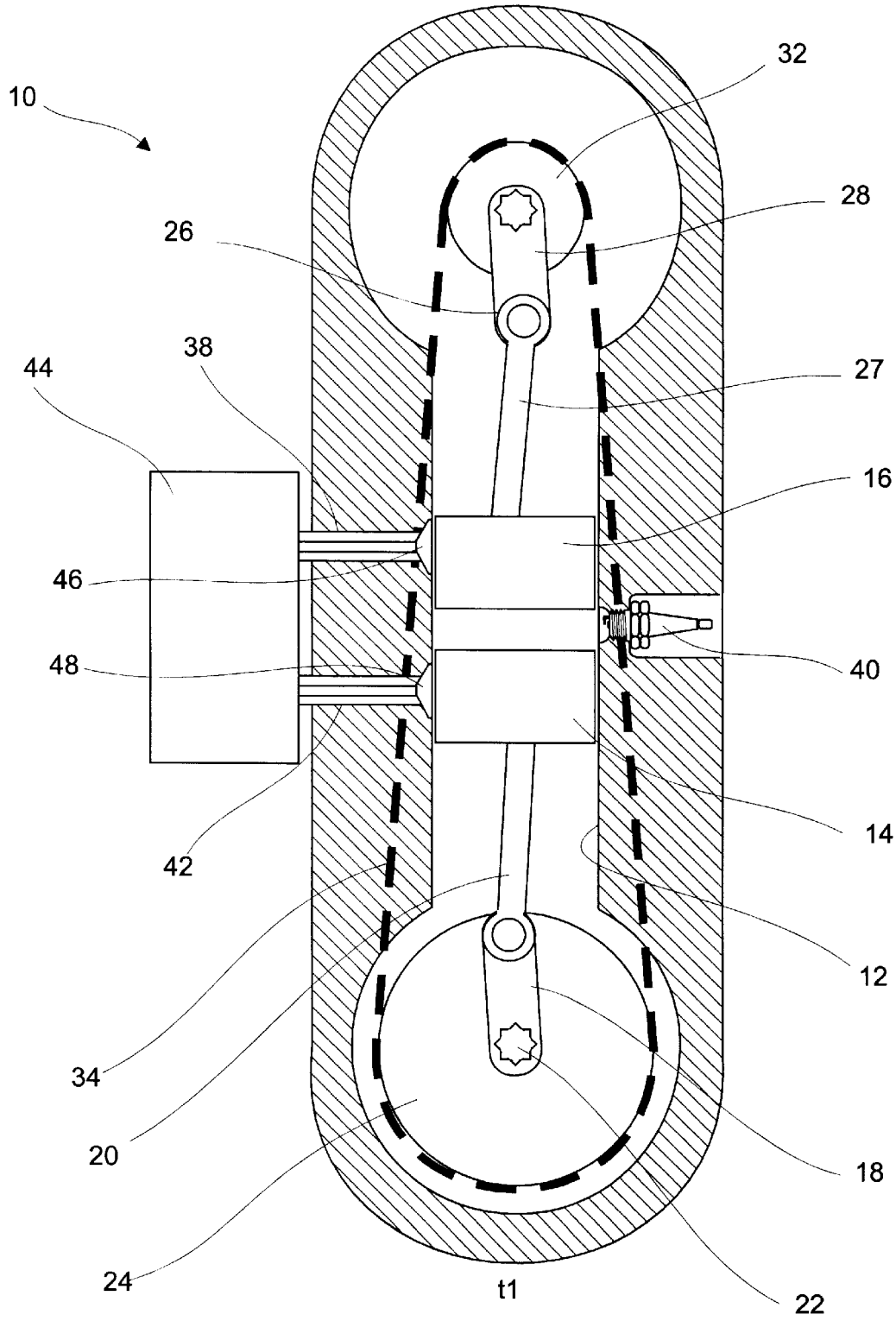
FIG. 4 shows a position of pistons at $t_1$ without added means for phase shifting.
Figure 4A:
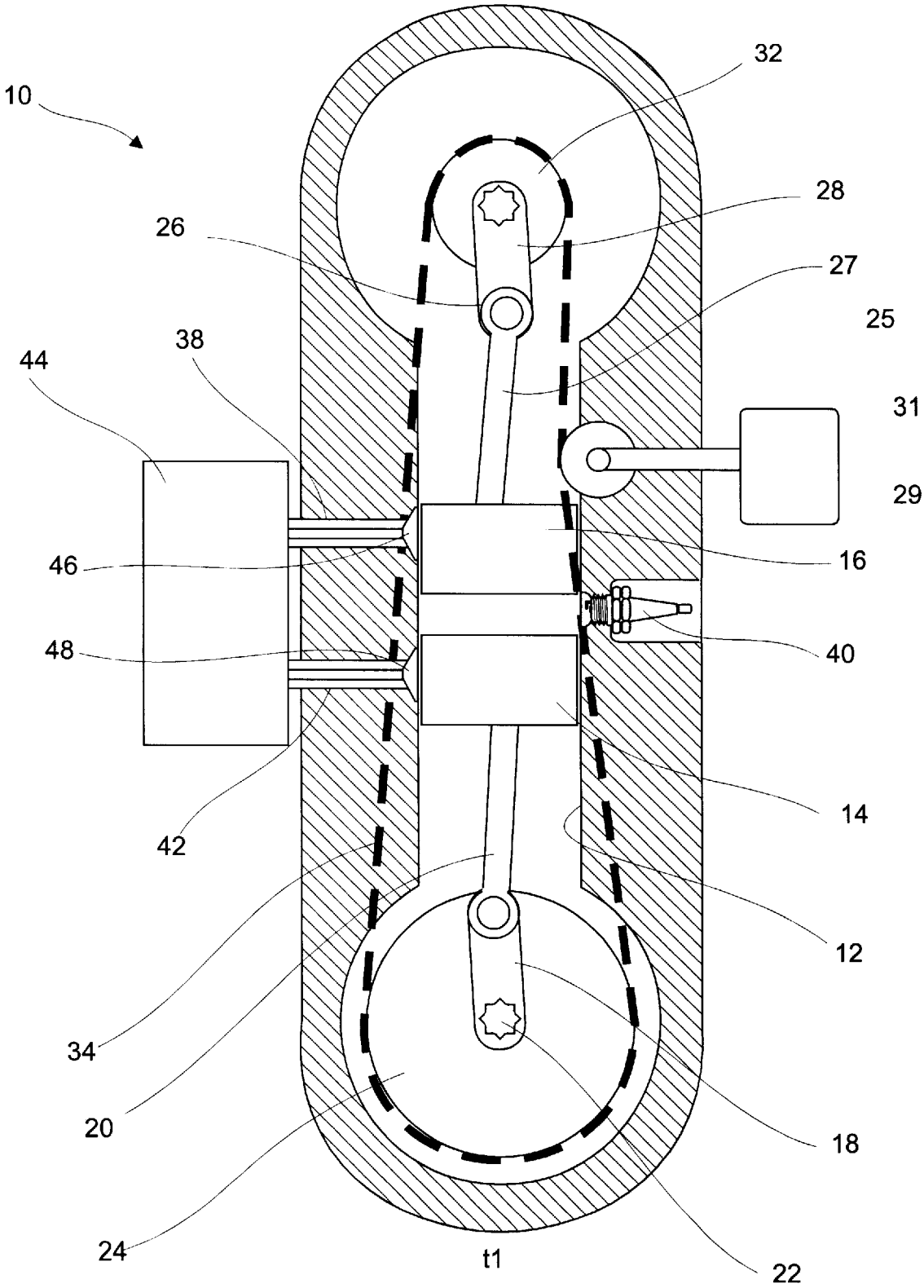
FIG. 4*a* shows a position of pistons at $t_1$ with added means for phase shifting.
Figure 5:
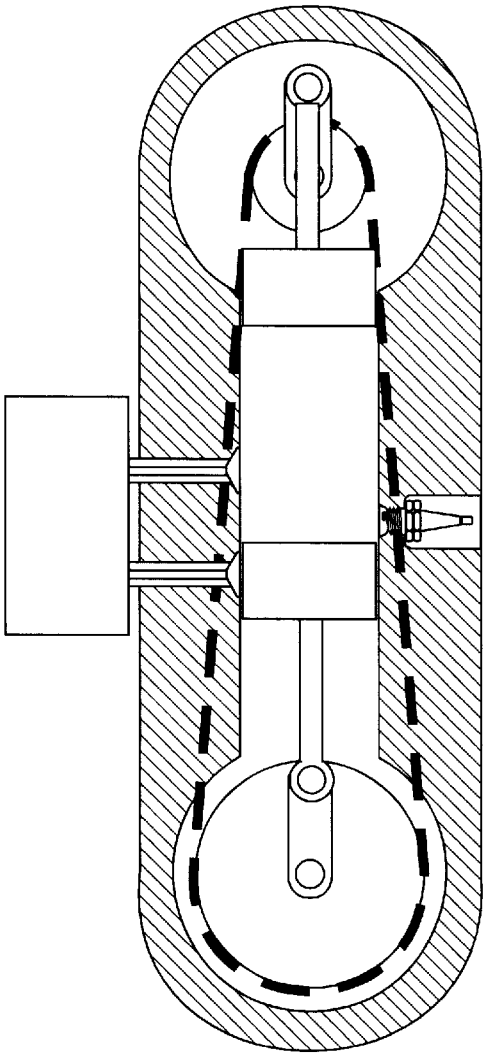
FIG. 5 shows a position of pistons at $t_2$.
Figure 6:
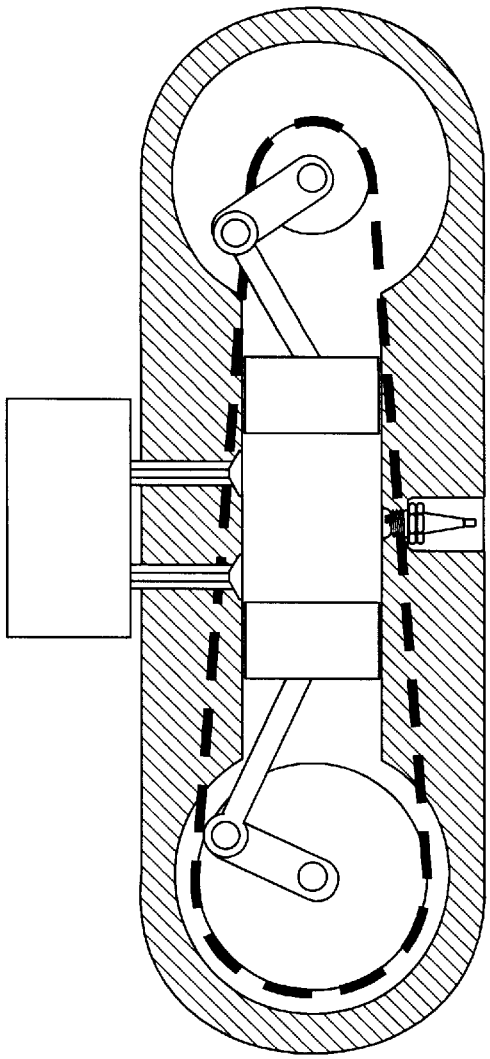
FIG. 6 shows a position of pistons at $t_3$.
Figure 7:
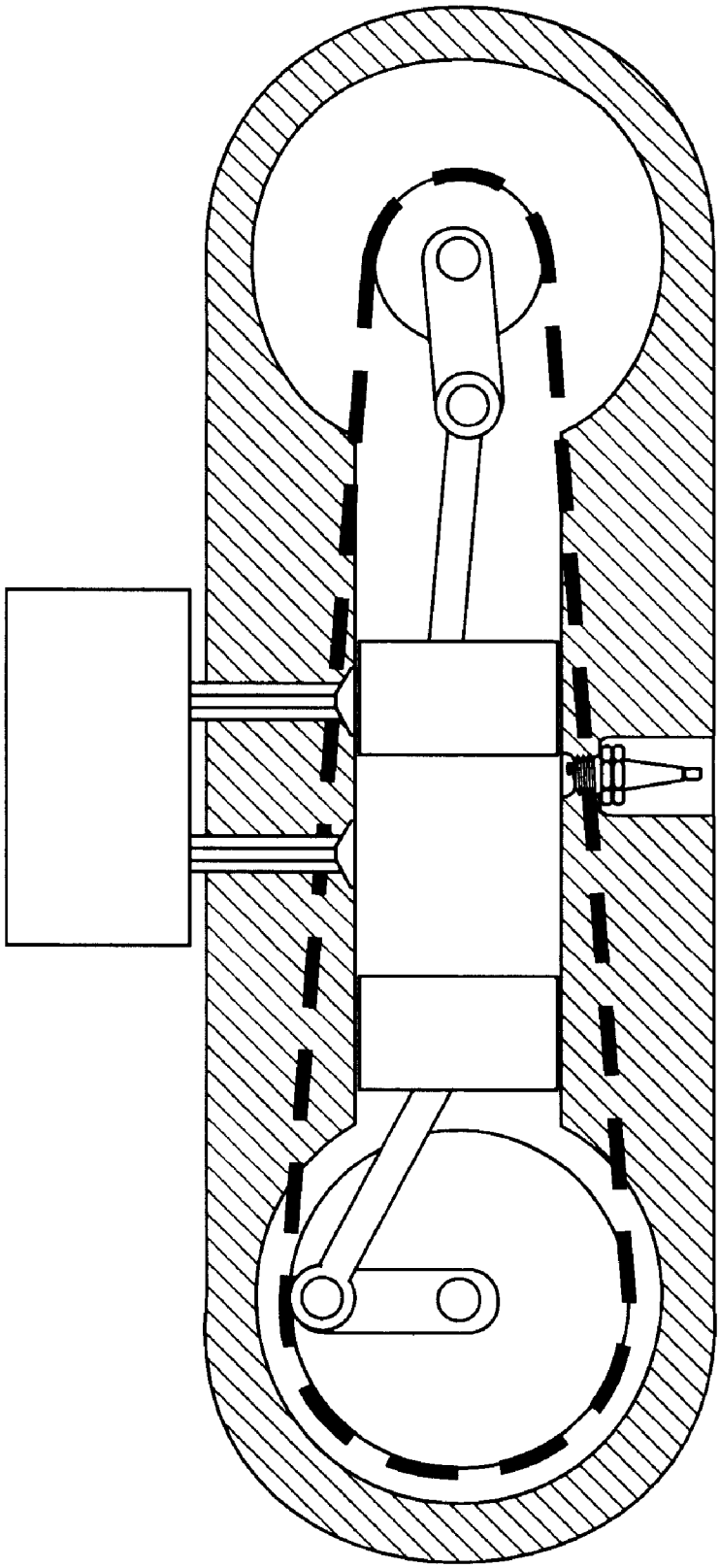
FIG. 7 shows a position of pistons at $t_4$.
Figure 8:
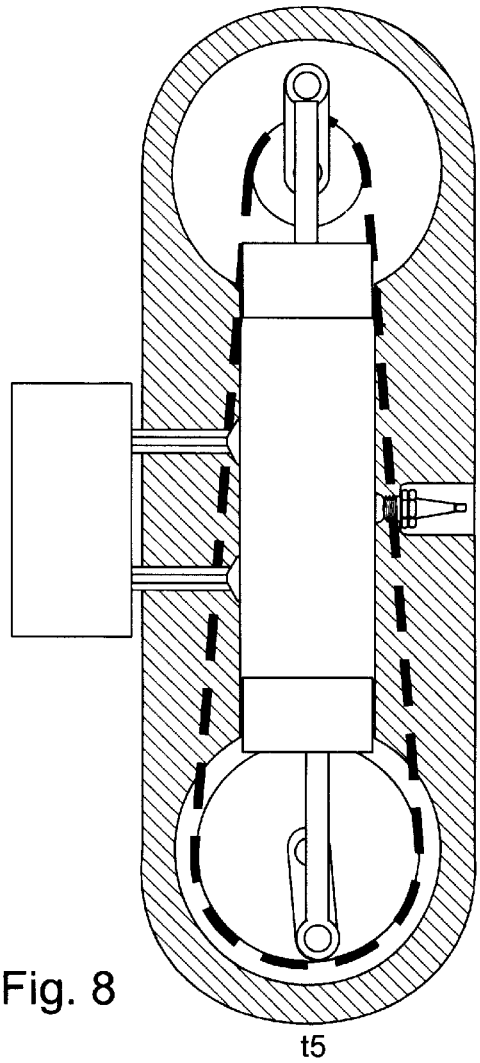
FIG. 8 shows a position of pistons at $t_5$.
Figure 9:
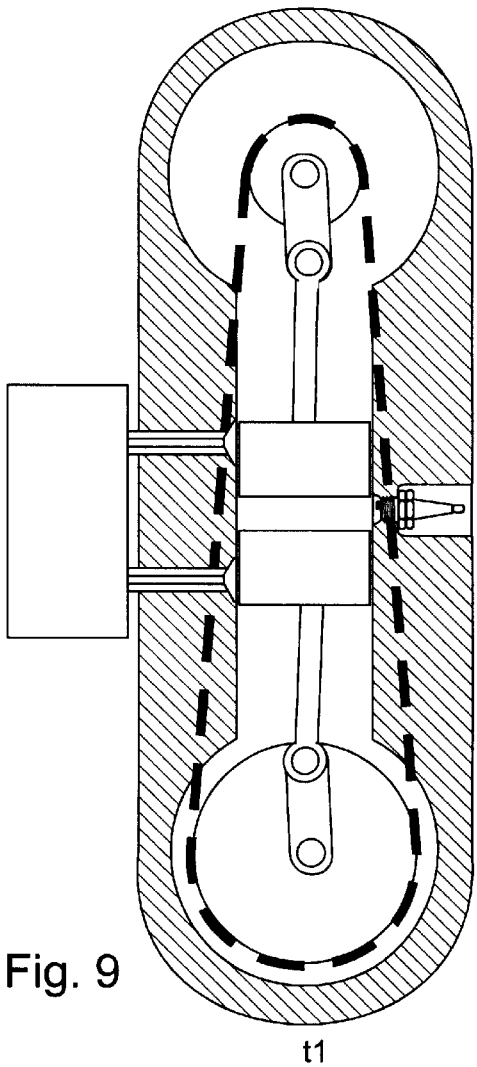
FIG. 9 shows a position of pistons at $t_1$.
Figure 10:
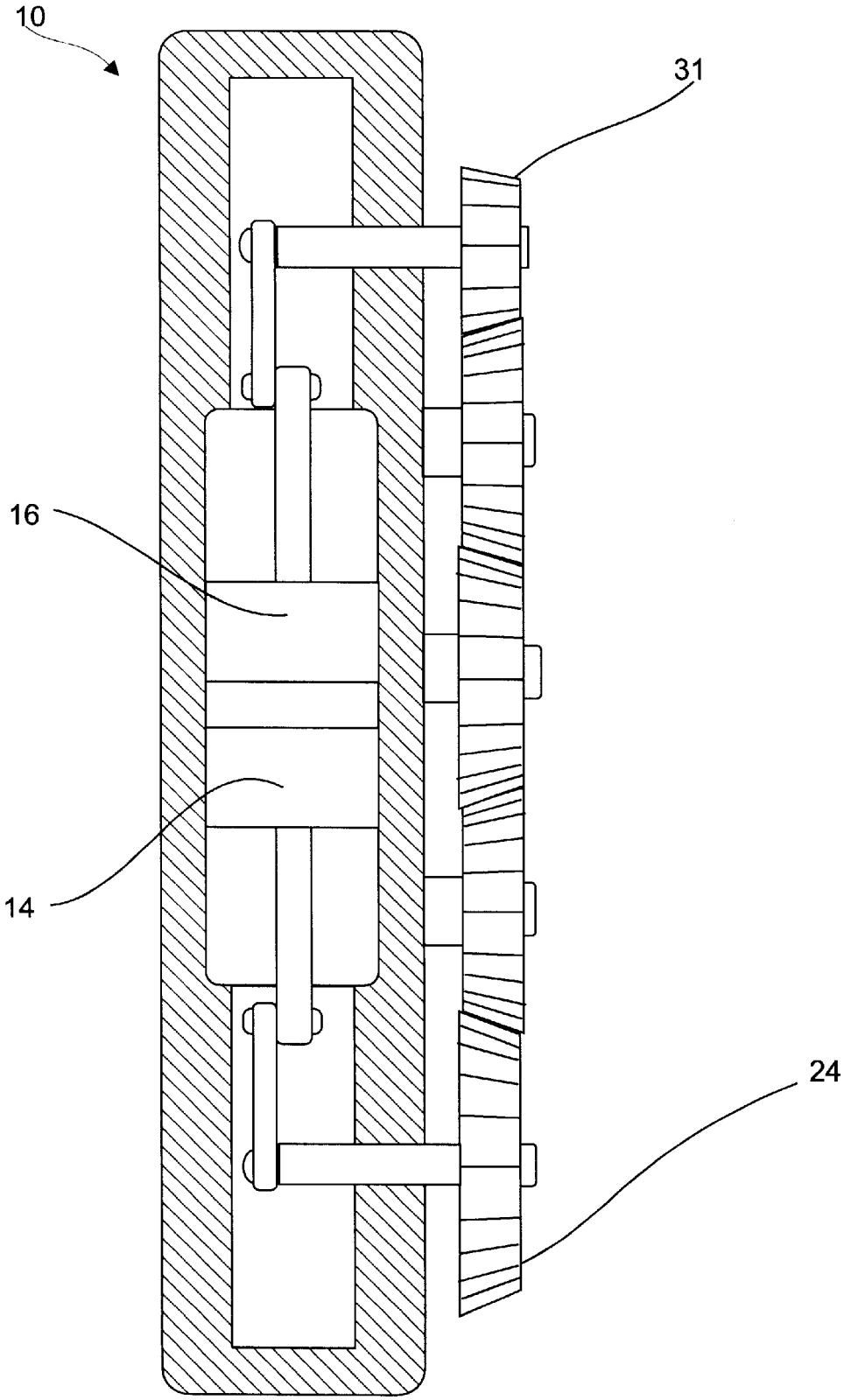
FIG. 10 shows an alternative embodiment of the means for phase shifting the pistons.
Figure 11:
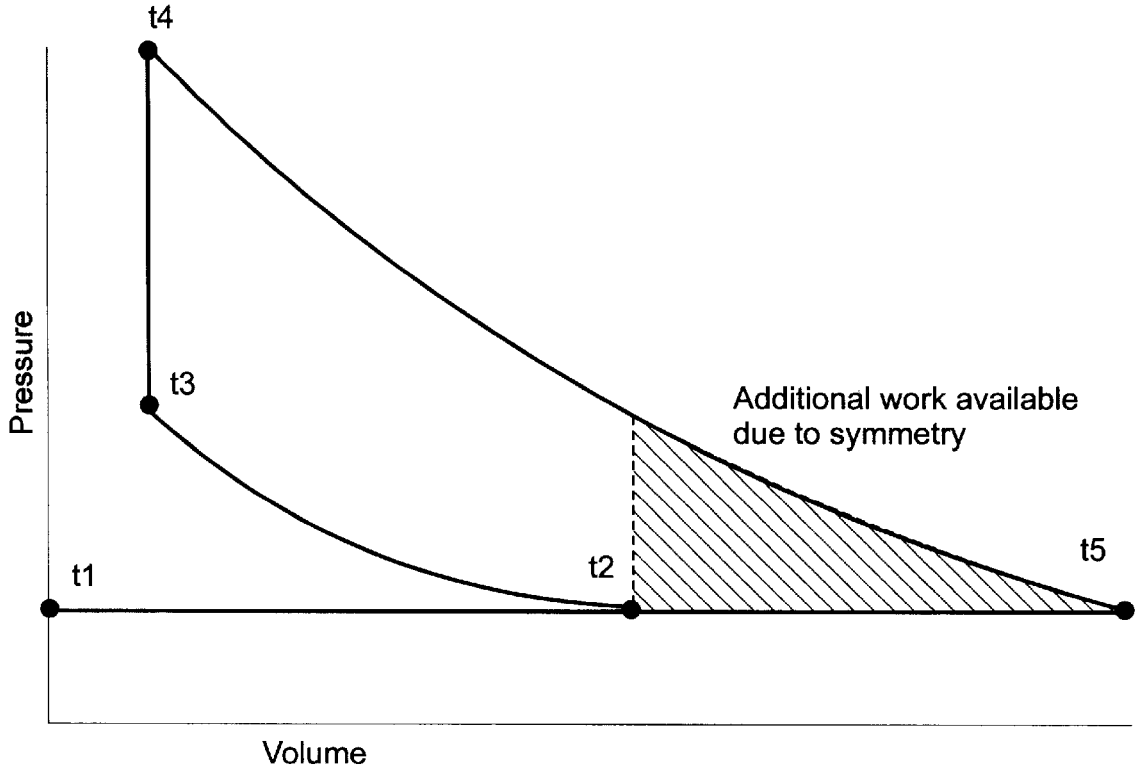
FIG. 11 shows a graphical representation of t he additional work achievable by employing the present invention.
Figure 4A:
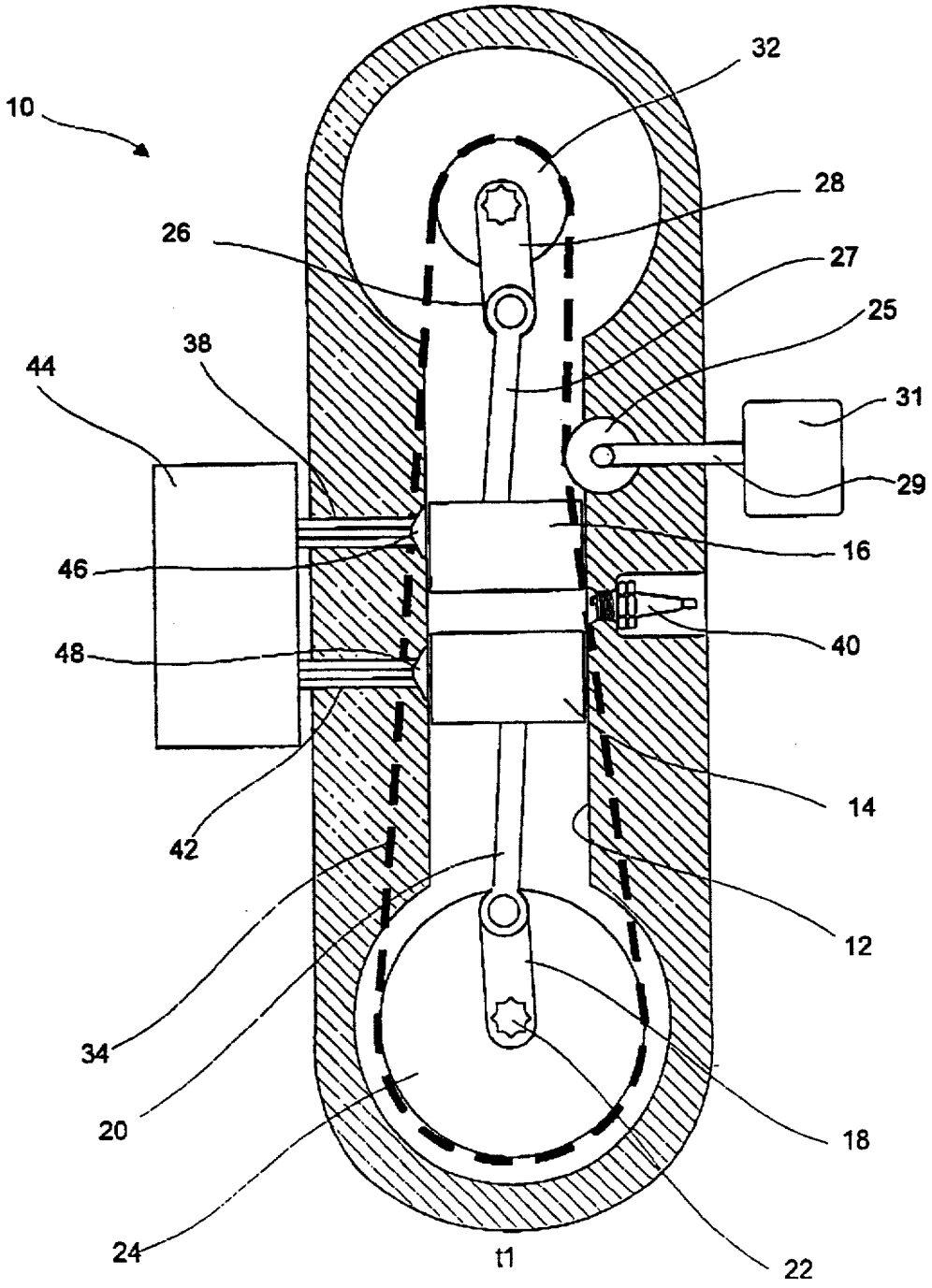

PATENT NO. : 6,230,671 B1
DATED : May 15, 2001
INVENTOR(S) : Raymond C. Achterberg It is certified that error appears in the above-identified patent and that said Letters Patent is hereby corrected as shown below:

In Fig. 4a of the drawings, the numerals 25, 31 and 29 should include lead lines as shown in the attached copy of Fig. 4a.

Signed and Sealed this

Nineteenth Day of February, 2002

*Attest:*

*Attesting Officer*

JAMES E. ROGAN
*Director of the United States Patent and Trademark Office*